United States Patent [19]

Wyatt

[11] Patent Number: 4,703,635

[45] Date of Patent: Nov. 3, 1987

[54] RURAL MAILBOX LOCK

[76] Inventor: Kenneth K. Wyatt, 4577 Daisy St., Springfield, Oreg. 97478

[21] Appl. No.: 910,021

[22] Filed: Sep. 22, 1986

[51] Int. Cl.[4] ..... E05B 65/52

[52] U.S. Cl. ..... 70/63; 70/159

[58] Field of Search ..... 70/63, 158, 159, 160–162, 70/360, 361; 232/4, 17, 19, 45; D99/29

[56] References Cited

U.S. PATENT DOCUMENTS 3,602,424 8/1971 Raulston ..... 232/35

3,968,985 7/1976 Nielsen ..... 70/63

4,565,080 1/1986 Kincaid ..... 70/360

*Primary Examiner*—Robert L. Wolfe

*Attorney, Agent, or Firm*—James D. Givnan, Jr.

[57] ABSTRACT

A lock assembly for installation on a rural type mailbox. A catch is attachable to the interior surface of the mailbox door and has an offset arm positionable interiorly of the mailbox. A plunger type lock is finger actuated by the postman and includes a bolt extendable into the mailbox interior to engage an opening in the catch arm. The plunger type lock is spring biased to an unlocked position upon key actuation by the box owner.

8 Claims, 4 Drawing Figures

RURAL MAILBOX LOCK

BACKGROUND OF THE INVENTION

The present invention pertains generally to lockable mailboxes and particularly to a lock attachment compatible with governmental approved conventional rural mailboxes.

Thievery from mailboxes along roadways and streets is not uncommon and appears to be increasing. Such mailboxes are often remote or at least out of sight from the residence.

Solutions to this problem have been proposed, but for the most part, have not been acceptable for reasons of cost or being in conflict with postal regulations. Any locking arrangement adding to the postman's workload are undesirable for obvious reasons.

Further, any modification of goverment approved rural mailboxes must take into consideration that the locking feature must not require substantial box modification to jeopardize the approved status.

SUMMARY OF THE PRESENT INVENTION

The present invention is embodied in a mailbox locking arrangement including a fingertip operated lock actuated during closure of the mailbox door.

A plunger type lock is mounted atop the curved upper extremity of the rural mailbox and is rearwardly offset from the forward end of the box. A latch is adapted for mounting on the box door utilizing existing door mounted fastener openings. An arm of the latch receives the lock bolt and is positioned off the vertical medial plane of the mailbox to avoid interference with the conventional friction latch of the box.

Important objectives include the provision of a mailbox lock assembly that requires virtually no additional effort on the postman's part to lock same; the provision of a lock that entails no substantial modification of the mailbox and may even use certain fastener receiving openings already provided during mailbox manufacture; and the provision of a mailbox lock that may be added to existing mailboxes by the homeowner.

DETAILED DESCRIPTION OF THE PREFERRED EMBODIMENTS

Figure 1:
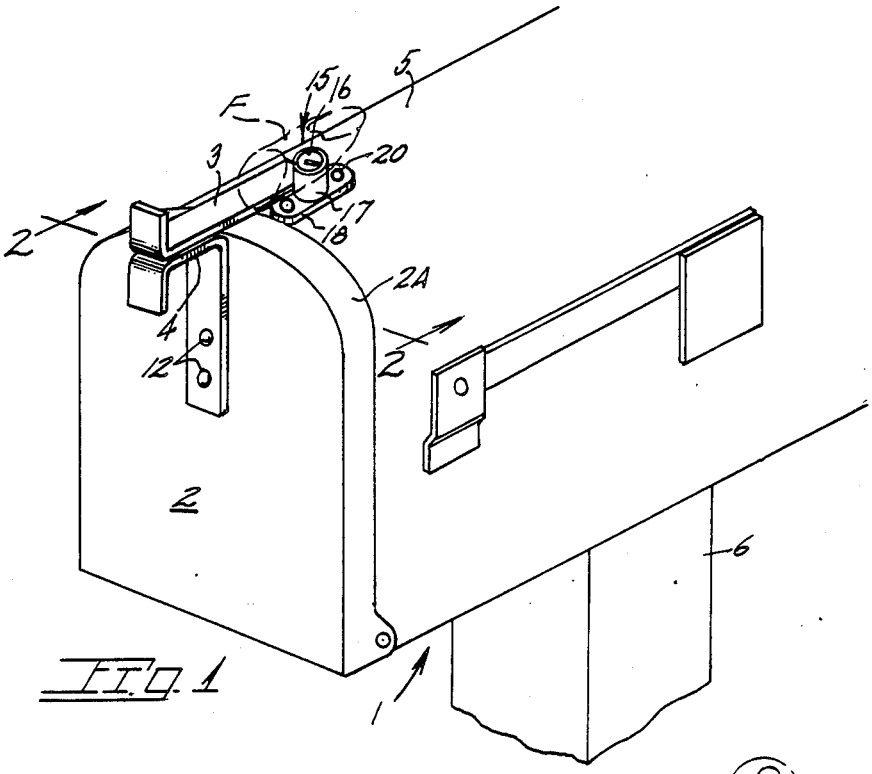
FIG. 1 is a fragmentary perspective view of a rural mailbox fitted with the present lock invention.
Figure 3:
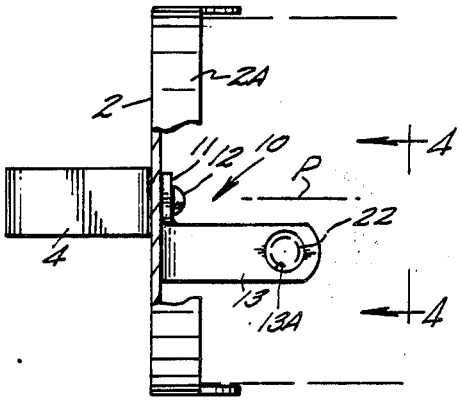
FIG. 3 is a plan view of the mailbox door removed from the mailbox and with fragements broken away.
Figure 2:
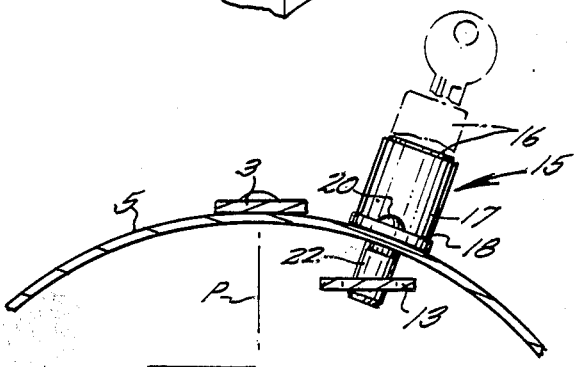
FIG. 2 is a vertical sectional view taken along line 2—2 of FIG. 1.
Figure 4:
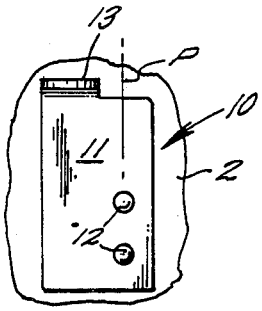
FIG. 4 is an elevational view taken along line 4—4 of FIG. 3.

With continuing attention to the drawings wherein applied reference numerals indicate parts similarly hereinafter identified, the reference numeral 1 indicates generally a conventional rural mailbox having a door 2.

Such mailboxes have a friction latch comprising upper and lower members 3 and 4, the latter of which is carried by door 2. Typically the mailbox has a curved top wall 5 with the upper edge of door 2 being similarly curved and flanged at 2A to overlie the forward margin of the mailbox. Such mailboxes are supported by a post 6 or side-by-side in a row on a common platform.

The present lock includes a door mounted catch generally at 10 of angular shape with a base 11 thereof held in place against the interior surface of the door by rivets or tamper proof fasteners 12. An arm at 13 extends generally horizontally for positioning into the mailbox interior upon door closure. Arm 13 is offset somewhat to locate an opening 13A at the arm inner end off center relative a vertical medial plan P of the mailbox.

A plunger type, key opened lock is indicated generally at 15 with a finger (at F) actuated plunger at 16 within a lock housing at 17. The housing is provided with flanges at 18 which are apertured to receive fastener assemblies 20 of the tamper proof type. Such locks are known in the lock trade as surface type drawer or door locks. The plunger 16 is integral with a bolt 22 which extends into the mailbox when plunger 16 is depressed. Interiorly of the lock housing 17 is a helical spring which biases both the bolt and the plunger to a raised or outward position to disengage the bolt from catch arm 13A upon unlocking of the key operated lock.

In use, the mailbox owner leaves lock 15 with a raised plunger and bolt. After delivery, the postman closes door 2 in the usual manner and with a fingertip of the door closing hand exerts a downward pressure on plunger 16. The lock automatically locks with bolt 22 occupying arm opening 13A. Access to the box thereafter requires a key to release the plunger and lock.

While a rural mailbox is shown with a curved upper wall, it is understood that this invention is usable with mailboxes of other shapes and sizes including those having flat wall surfaces.

While I have shown but one embodiment of the invention, it will be apparent to those skilled in the art that the invention may be embodied still otherwise without departing from the spirit and scope of the invention.

Having thus described the invention, what is desired to be secured in a Letters Patent is:

1. A lock assembly for securing the door of a rural mailbox, said lock assembly comprising, a catch for securement to the inner side of the door, said catch including an arm defining an opening, a plunger type lock having a finger actuated plunger and an axially positionable bolt engageable with the arm opening in its extended operative position, means securing said catch to said door, and means mounting said lock to said mailbox.

2. The lock assembly claimed in claim 1 where in said securing means additionally serves to secure a door latch member.

3. The lock assembly claimed in claim 2 wherein the arm opening is offset from a vertical medial plane of the mailbox.

4. The lock assembly claimed in claim 3 wherein said plunger type lock is of the key operated type.

5. A lockable rural mailbox comprising in combination, an enclosure including an upper wall member and a door, cooperating friction latch members centrally disposed on said upper wall member and said door, a key operated lock mounted on said upper wall member adjacent one of said latch members and having a finger actuated plunger and bolt, the latter postionable into the enclosure interior subjacent said upper wall member, a catch on said door and extending into the enclosure interior, said plunger and said catch engageable with one another to prevent door opening, and said plunger and bolt being spring biased to an unlocked position.

6. The lock assembly claimed in claim 5 wherein said catch includes an arm with a distal end offset from the vertical medial plane of the mailbox.

7. The lock assembly claimed in claim 6 wherein said catch is of angle configuration, said distal end defining an aperture to receive said plunger.

8. In combination, a rural mailbox including an enclosure and a door, latch members centrally disposed relative a vertical medial plane of said enclosure and door for frictional engagement with one another, a catch centrally disposed on said door and including an arm offset from the verticle medial plane of the mailbox, and a lock on said enclosure also offset from the vertical medial plane of the mailbox and having bolt engageable with said arm when the door is closed, said lock located adjacent one of said latch members on the enclosure and having a finger actuated plunger for finger actuation subsequent to door closure.

* * * * *